US009430993B2

(12) United States Patent
Nagatsuma

(10) Patent No.: US 9,430,993 B2
(45) Date of Patent: Aug. 30, 2016

(54) KEYBOARD LID OPENING AND CLOSING APPARATUS AND KEYBOARD INSTRUMENT

(71) Applicant: CASIO COMPUTER CO., LTD., Shibuya-ku, Tokyo (JP)

(72) Inventor: Shigeyuki Nagatsuma, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/575,995

(22) Filed: Dec. 18, 2014

(65) Prior Publication Data

US 2015/0179151 A1 Jun. 25, 2015

(30) Foreign Application Priority Data

Dec. 24, 2013 (JP) ..... 2013-265204

(51) Int. Cl.
*G10C 3/02* (2006.01)
*G10C 3/12* (2006.01)
*G10H 1/32* (2006.01)

(52) U.S. Cl.
CPC . *G10C 3/02* (2013.01); *G10C 3/12* (2013.01); *G10H 1/32* (2013.01)

(58) Field of Classification Search
CPC ..... G10C 3/02; G10C 3/12; G10H 1/32
USPC ..... 84/179, 423 R
See application file for complete search history.

(56) References Cited

U.S. PATENT DOCUMENTS 2,530,251 A * 11/1950 Luberoff ..... G10H 3/18 369/69
4,693,525 A * 9/1987 Shinoto ..... B41J 29/15 312/208.4
4,742,749 A * 5/1988 Kira ..... G10C 3/02 84/179
5,308,937 A * 5/1994 Torii ..... H04R 1/02 181/141
5,429,026 A * 7/1995 Kimura ..... E06B 5/006 84/179
5,487,321 A * 1/1996 Kimura ..... E06B 5/006 312/312
5,973,241 A * 10/1999 Tetsumura ..... G10C 3/02 206/816
6,545,203 B2 * 4/2003 Arimori ..... E05F 5/10 84/179
6,673,991 B2 * 1/2004 Hara ..... G10C 3/02 84/179
7,495,158 B2 * 2/2009 Nagatsuma ..... G10C 3/02 84/179
7,700,860 B2 * 4/2010 Nagayama ..... G10C 3/02 84/179

(Continued)

FOREIGN PATENT DOCUMENTS

JP 2000187480 A * 7/2000
JP 2007133249 A * 5/2007

*Primary Examiner* — David Warren
*Assistant Examiner* — Christina Schreiber
(74) *Attorney, Agent, or Firm* — Holtz, Holtz & Volek PC

(57) ABSTRACT

The present invention includes a keyboard lid which is constituted by a front lid and a rear lid whose lengths in the front-rear direction of a keyboard section provided in an instrument case are different from each other being foldably connected to each other by a coupling member, and openably and closably covers the keyboard section; a rotary fulcrum section which supports the rear end portion of the rear lid such that the rear lid is rotatable with respect to the instrument case, and by which the keyboard lid is mountain-folded and the front lid is held upright above the rear portion of the keyboard section when the keyboard lid exposes the keyboard section; and a guide section which guides the front end portion of the front lid in the front-rear direction of the keyboard section. Accordingly, the keyboard lid can be stably and smoothly opened or closed.

14 Claims, 8 Drawing Sheets

(56) References Cited

U.S. PATENT DOCUMENTS

| | | | | |
|---|---|---|---|---|
| 8,330,027 | B2 * | 12/2012 | Kono | G10H 1/32 84/179 |
| 2003/0221537 | A1 * | 12/2003 | Hara | G10C 3/02 84/179 |
| 2008/0066605 | A1 * | 3/2008 | Ooi | G10C 3/02 84/177 |
| 2012/0174726 | A1 * | 7/2012 | Kono | G10H 1/32 84/179 |
| 2013/0008296 | A1 * | 1/2013 | Tsuchimoto | G10H 1/32 84/179 |
| 2013/0283994 | A1 * | 10/2013 | Irimura | G10C 3/02 84/179 |
| 2013/0305899 | A1 * | 11/2013 | Nagatsuma | G10H 1/32 84/423 R |
| 2013/0305900 | A1 * | 11/2013 | Nagatsuma | G10H 1/32 84/423 R |
| 2013/0305901 | A1 * | 11/2013 | Hoshino | G10C 3/12 84/436 |

* cited by examiner

KEYBOARD LID OPENING AND CLOSING APPARATUS AND KEYBOARD INSTRUMENT

CROSS-REFERENCE TO RELATED APPLICATION

This application is based upon and claims the benefit of priority from the prior Japanese Patent Application No. 2013-265204, filed Dec. 24, 2013, the entire contents of which is incorporated herein by reference.

BACKGROUND OF THE INVENTION

1. Field of the Invention

The present invention relates to a keyboard lid opening and closing apparatus that are used in keyboard instruments such as pianos and organs, and a keyboard instrument provided with the keyboard lid opening and closing apparatus.

2. Description of the Related Art

A keyboard lid opening and closing apparatus in a keyboard instrument such as an electric piano is known in which a keyboard lid that openably and closably covers a keyboard section provided in an instrument case is constituted by a plurality of plates sequentially connected to one another to be foldable, as shown in, for example, Japanese Patent Application Laid-Open (Kokai) Publication No. 2007-133249.

This type of keyboard lid opening and closing apparatus is structured such that, when the keyboard section of the keyboard instrument is to be covered by the keyboard lid, the plurality of plates are sequentially unfolded in a front-rear direction and thereby sequentially arranged above the keyboard section so as to cover this keyboard section. When the keyboard lid is to be opened to expose the keyboard section, the plates are sequentially folded and accommodated in the instrument case so as to expose the keyboard section.

However, this keyboard lid opening and closing apparatus for a keyboard instrument has problems in that the plurality of plates are not smoothly folded unless they are all formed in the same size, and do not stand upright stably when they are folded by being held upright, due to which their upper portions easily tilt in the front-rear direction. Accordingly, the folding of the plates of this keyboard lid opening and closing apparatus is bothersome.

SUMMARY OF THE INVENTION

An object of the present invention is to provide a keyboard lid opening and closing apparatus by which a keyboard lid can be stably and smoothly opened or closed, and a keyboard instrument provided with this keyboard lid opening and closing apparatus.

In accordance with one aspect of the present invention, there is provided a keyboard instrument comprising: a keyboard section; an instrument case in which the keyboard section is provided; a keyboard lid which has a front lid and a rear lid connected by a coupling member such that the keyboard lid is foldable, and exposes the keyboard section in a folded state; a rotary fulcrum section which is provided above the keyboard section, and rotates a rear end portion of the rear lid so that the rear lid is held above the keyboard section with a front end portion of the rear lid being positioned higher than the rear end portion of the rear lid, when the keyboard lid exposes the keyboard section; and a guide section which guides a front end portion of the front lid toward an area below the rotary fulcrum section so that the front lid is held above the keyboard section with a rear end portion of the front lid being positioned higher than the front end portion of the front lid, when the keyboard lid exposes the keyboard section.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS (First Embodiment)

A first embodiment in which the present invention has been applied in a keyboard instrument will hereinafter be described with reference to FIG. 1 and FIG. 2.

Figure 1:
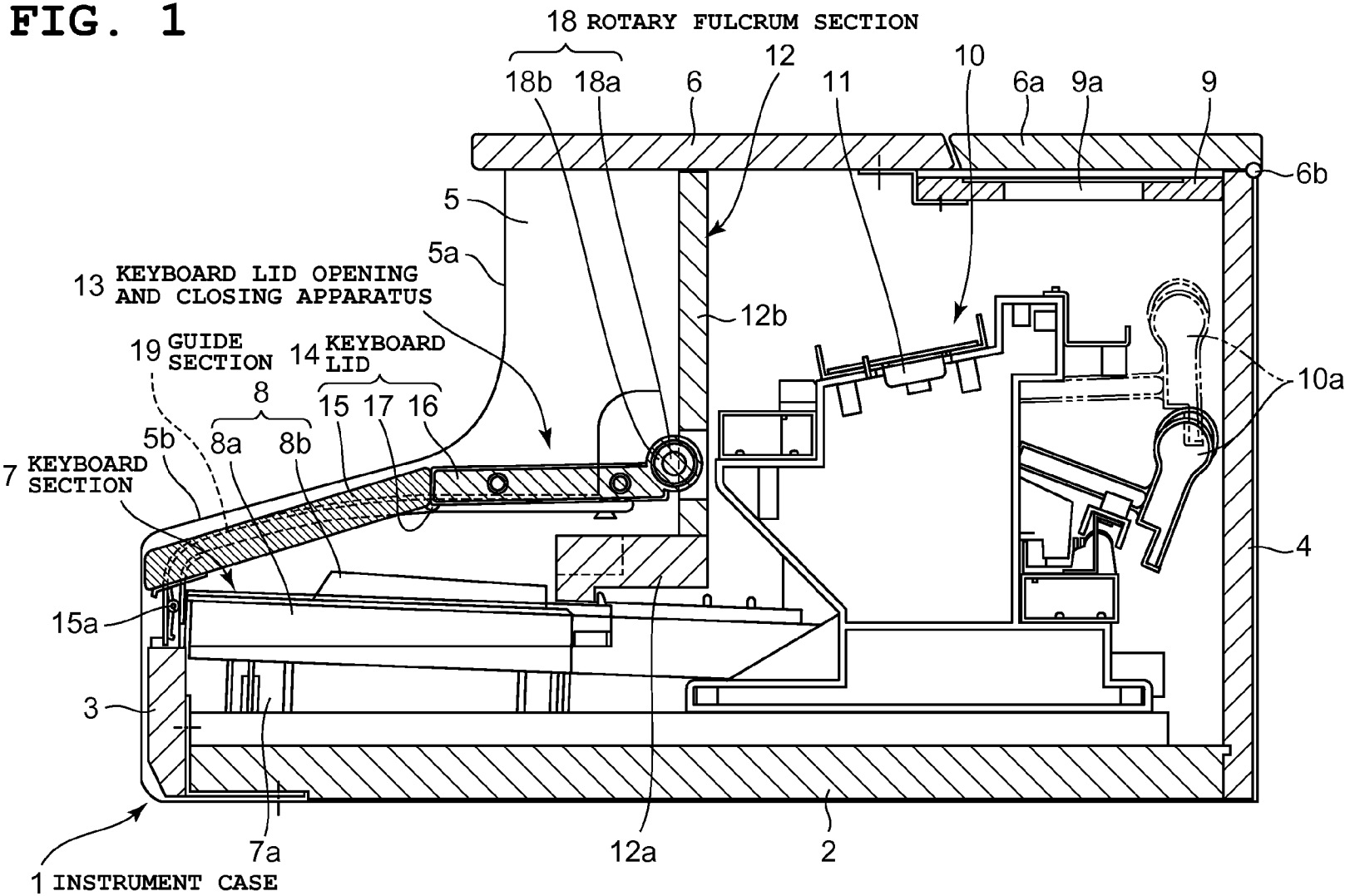
FIG. 1 is a sectional view of a first embodiment where the present invention has been applied in a keyboard instrument, in which a keyboard lid, has been closed to cover a keyboard section.
Figure 2:
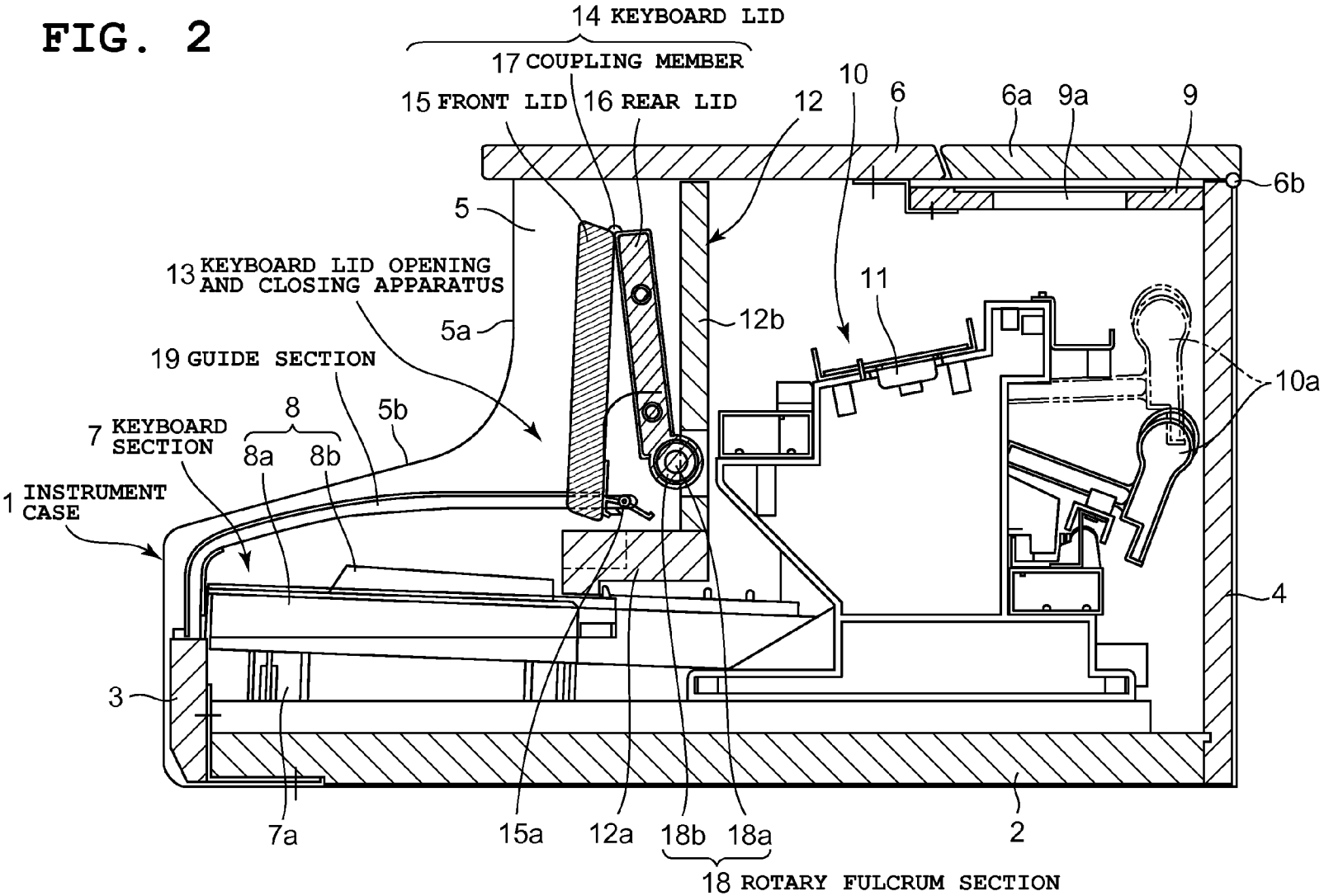
FIG. 2 is a sectional view of the keyboard instrument shown in FIG. 1, in which the keyboard lid has been mountain-folded to expose the keyboard section.

As shown in FIG. 1 and FIG. 2, this keyboard instrument includes an instrument case 1.

This instrument case 1 includes abase plate 2, a front plate 3 provided upright on the front end (left end in FIG. 1) of the base plate 2, a rear plate 4 provided upright on the rear end (right end in FIG. 1) of the base plate 2, a pair of side plates 5 provided upright on the sides (near and far side surfaces in FIG. 1) of the base plate 2, and a top plate 6 provided on the upper ends of the rear plate 4 and the side plates 5. In this embodiment, the height of the front plate 3 is formed to be equal to or shorter than half the height of the rear plate 4.

The side plates 5 are each formed such that its front side (left side in FIG. 1) is slightly higher than the front plate 3, and its rear side (right side in FIG. 1) is the same height as the rear plate 4, as shown in FIG. 1 and FIG. 2. As a result, the upper portion of a boundary area between the front side and the rear side of each side plate 5 forms a descending section 5*a* having a substantially vertical descending surface, and the lower portion below this descending section 5*a* forms a tilted section 5*b* gently inclined toward the lower portion of the front end of the side plate 5.

Also, in this embodiment, a keyboard lid supporting section 5*c* which supports and guides a keyboard lid 14 is embedded in each of the pair of side plates 5.

The top plate 6 is mounted across the rear portions of the upper ends of the side plates 5 and the upper end of the rear plate 4, as shown in FIG. 1 and FIG. 2. As a result, the instrument case 1 has a substantially box shape whose portion on the side of the front portions of the side plates 5 has been exposed upwardly. In this embodiment, a sound emission lid 6*a* is provided in the area of the rear portion of the top plate 6 such that it is openable and closable, and an auxiliary top plate 9 is formed below this sound emission lid 6*a*.

The front end portion of this auxiliary top plate 9 is attached to the lower side of the rear end portion of the top plate 6, and the rear end portion thereof is attached to the upper inner surface of the rear plate 4, as shown in FIG. 1 and FIG. 2. In the auxiliary top plate 9, a sound hole 9*a* is provided penetrating through the auxiliary top plate 9. In this embodiment, the rear end portion of the sound emission lid 6*a* is rotatably attached to the upper end of the rear plate 4 by a hinge 6*b*, and the sound emission lid 6*a* is vertically rotated centering on the hinge 6*b* so as to open or close the sound hole 9*a* of the auxiliary top plate 9.

In the front side of the instrument case 1, a keyboard section 7 is provided in a state of being exposed upward, as shown in FIG. 1 and FIG. 2. The keyboard section 7 includes a keyboard chassis 7*a* provided on the base plate 2 of the instrument case 1, and a plurality of keys 8 arranged in parallel on the keyboard chassis 7*a*. These keys 8 are constituted by white keys 8*a* and black keys 8*b*. The rear end portion of each key 8 is attached to the keyboard chassis 7*a* such that it is rotatable in a vertical direction, and the keys 8 in this state are exposed toward the upper front of the instrument case 1.

In the instrument case 1, an action mechanism section 10 which applies an action load to each key 8 of the keyboard section 7 is provided to be positioned behind the keyboard section 7, as shown in FIG. 1 and FIG. 2. This action mechanism section 10 is structured such that , when a key 8 is depressed, a hammer member 10*a* corresponding to the pressed key 8 is rotated and whereby an action load is applied to this key 8.

That is, this action mechanism section 10 is structured such that a key-press feel similar to that of an acoustic piano is achieved by an action load being applied to a key 8, as shown in FIG. 1 and FIG. 2. in addition, this action mechanism section 10 includes a switching circuit section 11 which performs a switching operation when the hammer member 10*a* is rotated and an action load is applied to a key 8. The switching circuit section 11 is structured to output an electrical signal that generates a musical sound from a loudspeaker (not shown in the first embodiment) by a switching operation.

In this embodiment, in the instrument case 1, a partition member 12 is provided as a partition between the keyboard section 7 and the action mechanism section 10, as shown in FIG. 1 and FIG. 2. This partition member 12 includes a cover plate 12*a* that covers the rear end portions of the plurality of keys 8 of the keyboard section 7, and an upper front plate 12*b* that is provided substantially upright on the rear end portion of the cover plate 12*a*. The upper front plate 12*b* is arranged such that it is located at a position shifted rearward from the front end portion of the top plate 6, and its upper end portion is positioned on the undersurface of the top plate 6.

As shown in FIG. 1 and FIG. 2, in the instrument case 1, a keyboard lid opening and closing apparatus 13 for openably and closably covering the keyboard section 7 is provided, which includes the keyboard lid 14 that openably and closably covers the keyboard section 7. The keyboard lid 14 includes a front lid 15 and a rear lid 16 whose lengths in the longitudinal direction of the keyboard section 7 differ from each other, which are foldably connected by a coupling member 17 such as a hinge.

That is, the keyboard lid 14 is unfolded to be in a substantially platelike form by the front lid 15 and the rear lid 16 being rotated centering on the coupling member 17, and arranged above the keyboard section 7 in this state, whereby the front lid 15 covers the front side of the keyboard section 7 and the rear lid 16 covers the rear side thereof, as shown in FIG. 1 and FIG. 2. In this embodiment, the length of the front lid 15 in the longitudinal direction is formed longer than that of the rear lid 16.

Figure 8:
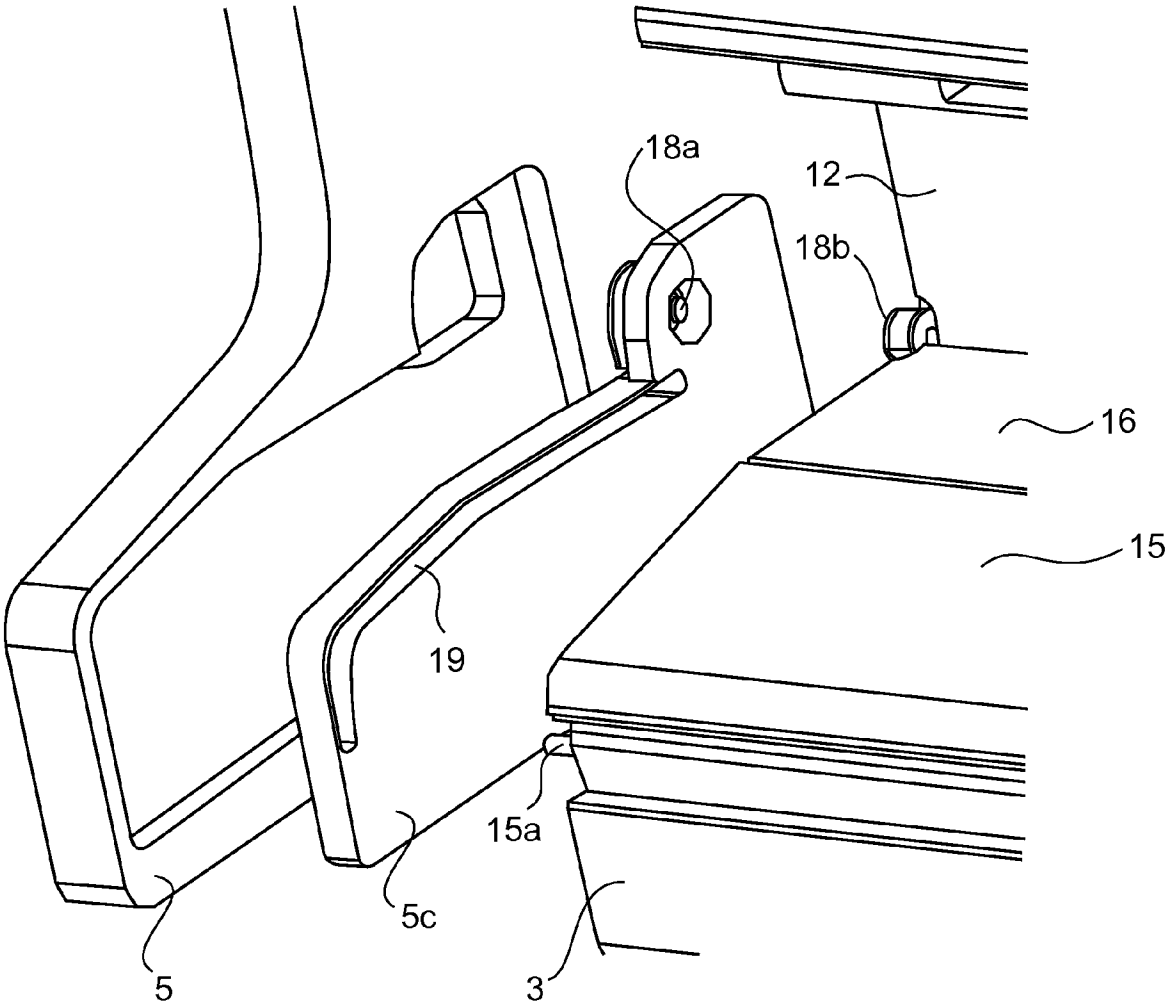
FIG. 8 is a perspective view of a keyboard lid supporting section that is embedded in each of a pair of side plates.

The keyboard lid opening and closing apparatus 13 includes rotary fulcrum sections 18 which support the rear end portion of the rear lid 16 such that the rear lid 16 is rotatable with respect to the instrument case 1, and guide sections 19 which guide the front end portion of the front lid 15 in the front-rear direction of the keyboard section 7, as shown in FIG. 1, FIG. 2, and FIG. 8. Each of the rotary fulcrum sections 18 is a hinge section, and includes a shaft section 18*a* provided in one of the keyboard lid supporting sections 5*c* in the pair of side plates 5 and positioned in the lower portion of the upper front plate 12*b* of the partition member 12, and a cylindrical bearing section 18*b* provided in the upper portion of the rear end of the rear lid 16.

Figure 3:
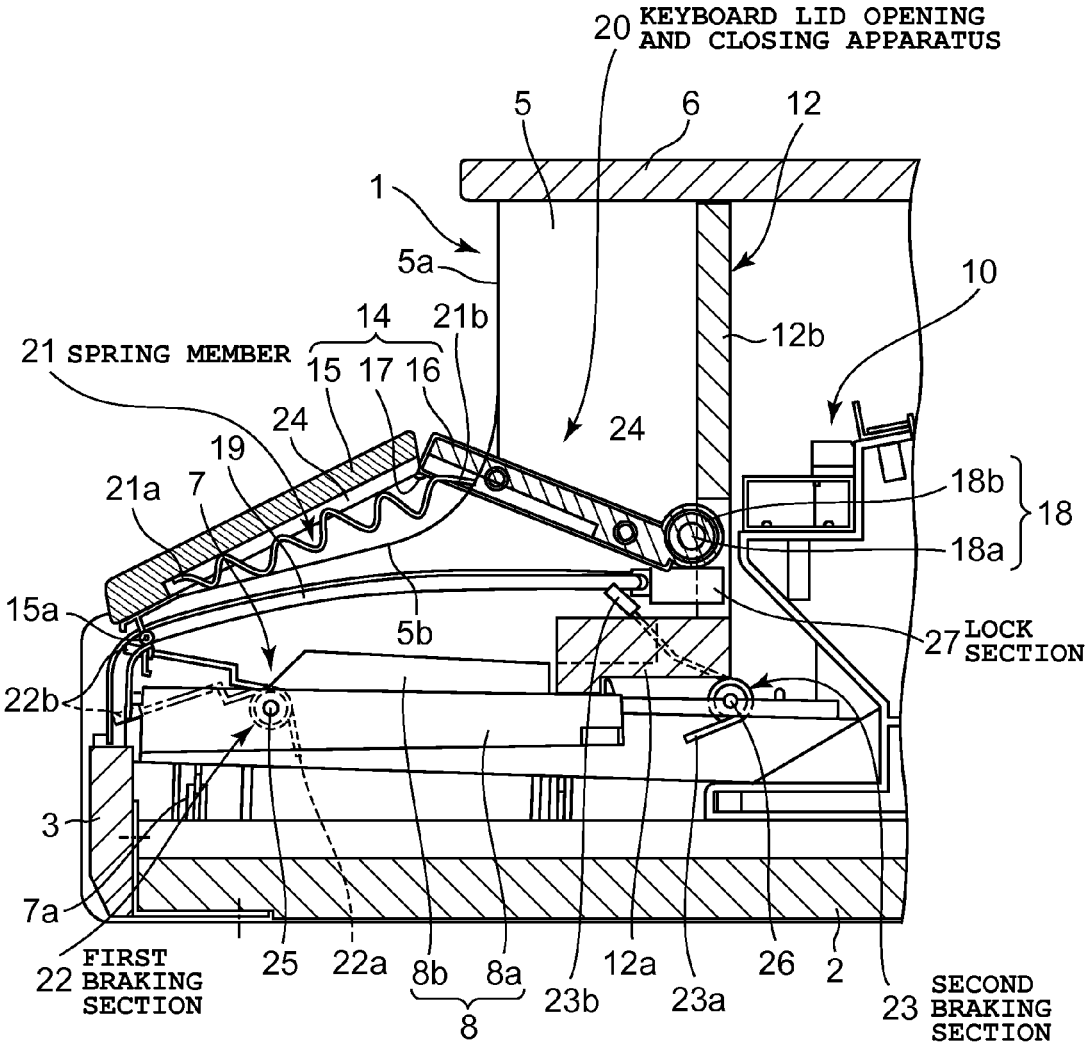
FIG. 3 is a sectional view of the main section of a second embodiment where the present invention has been applied in a keyboard instrument, in which a keyboard lid is being closed to cover a keyboard section.

As a result, each rotary fulcrum section 18 is structured such that the shaft section 18*a* provided in one of the keyboard lid supporting sections 5*c* embedded in the pair of side plate 5 is inserted into the bearing section 18*b* of the rear lid 16, and the rear lid 16 is rotated in this state in the vertical direction, centering on the shaft section 18*a*, as shown in FIG. 1, FIG. 2, and FIG. 3. Also, each rotary fulcrum section 18 is structured such that, when being opened to expose the keyboard section 7 by the front lid 15 and the rear lid 16 being tilted by the coupling member 17, the keyboard lid 14 is folded such that surfaces of the front lid 15 and the rear lid 16 on the side of the keyboard section 7 come close to each other, and the front lid 15 is held upright above the rear portion of the keyboard section 7.

The guide sections 19 are grooves provided in the inner surfaces of the pair of side plates 5 in the instrument case 1 and guides, in the front-rear direction of the keyboard section 7, guide projection sections 15*a* provided on the lower portion of the front end of the front lid 15 and inserted into the guide sections 19, as shown in FIG. 1, FIG. 2, and FIG. 8. That is, each guide section 19 is continuously formed such that it rises from an area near the front end of the keyboard section 7, passes through an area above the keyboard section 7, and reaches an area above the cover plate 12*a* behind the keyboard section 7. The end portions of these grooves on the side of the cover plate 12*a* are formed to be gradually declined.

As a result, the keyboard lid 14 is structured such that, when unfolded to be in a substantially plate-like form by the front lid 15 and the rear lid 16 being rotated centering on the coupling member 17 and arranged above the keyboard section 7 in this state, the guide projection sections 15*a* of the front lid 15 are supported in the front end portions of the guide sections 19 with the front lid 15 being slightly tilted forward and downward, and the rear end portion of the rear lid 16 is supported by the rotary fulcrum sections 18 with the rear lid 16 being substantially horizontalized, as shown in FIG. 1. That is, the keyboard lid 14 is structured to cover the keyboard section 7 with the front lid 15 and the rear lid 16 being slightly tilted by the coupling member 17.

Also, the keyboard lid 14 is structured such that, when surfaces of the front lid 15 and the rear lid 16 on the side of the keyboard section 7 come close to each other by being tilted centering on the coupling member 17, and the keyboard lid 14 is opened thereby to expose the keyboard section 7, the front lid 15 is supported in a state of being held substantially upright by the guide projection sections 15*a* thereof being positioned in the rear end portions of the guide sections 19, and the rear lid 16 is held upright by the rear end portion thereof being supported by the rotary fulcrum sections 18, as shown in FIG. 2. Here, weight is added to the rear end portion of the standing front lid 15 from the front end portion of the rear lid 16 which is held upright by the rotary fulcrum sections 18, whereby the guide projection sections 15*a* stop movement in end portions of the guide sections 19 on the side of the cover plate 12*a*.

Next , the operation of the keyboard lid opening and closing apparatus 13 in this keyboard instrument is described.

When the keyboard lid 14 is closed to cover the keyboard section 7A, the rear lid 16 is substantially horizontally arranged above the rear portion of the keyboard section 7 by the rear end portion of the rear lid 16 being rotated around the rotary fulcrum sections 18 in the counterclockwise direction, and the front lid 15 and the rear lid 16 forma plate-like shape by being rotated centering on the coupling member 17, as shown in FIG. 1.

Here, the guide projection sections 15*a* provided on the front end portion of the front lid 15 are supported by the guide sections 19 with them being guided by the guide sections 19 and positioned in the front end portions of the guide sections 19, whereby the front lid 15 is arranged above the upper portion of the keyboard section 7 in a state of being slightly tilted forward and downward, as shown in FIG. 1.

Also, the rear end portion of the rear lid 16 is supported by the rotary fulcrum sections 18, whereby the rear lid 16 is substantially horizontally arranged above the rear portion of the keyboard section 7, as shown in FIG. 1, As a result, the keyboard lid 14 is arranged above the keyboard section 7 with the front lid 15 and the rear lid 16 being slightly tilted by the coupling member 17, and covers the keyboard section 7.

On the other hand, when opening the keyboard lid 14 in the state shown in FIG. 1 so as to expose the keyboard section 7, the instrument player holds the lower front end of the front lid 15, and pushes the front lid 15 in the posterior direction of the keyboard section 7 while being pushed upward. As a result, the guide projection sections 15*a* of front lid 15 start moving toward an area posterior to the keyboard section 7 along the guide sections 19, and the rear end portion of the rear lid 16 start rotating around the rotary fulcrum sections 18 in the clockwise direction.

Here, the front lid 15 and the rear lid 16 have been arranged above the keyboard section 7 with them being slightly tilted centering on the coupling member 17 by mountain folding, as shown in FIG. 1. Accordingly, when the guide projection sections 15*a* of the front lid 15 start moving toward the area posterior to the keyboard section 7 along the guide sections 19, the front lid 15 and the rear lid 16 start rotating around the coupling member 17, whereby they are gradually tilted.

Then, when the front lid 15 is further pushed toward the area posterior to the keyboard section 7, the guide projection sections 15*a* of the front lid 15 are further moved toward the area posterior to the keyboard section 7 along the guide sections 19, and the rear end portion of the rear lid 16 is further rotated around the rotary fulcrum sections 18 in the clockwise direction. Accordingly, the front lid 15 and the rear lid 16 are further rotated centering on the coupling member 17, and further tilted thereby. As a result, the rear end portion of the front lid 15 and the front end portion of the rear lid 16 are oriented upward.

In this state, when the front lid 15 is further pushed toward the area posterior to the keyboard section 7, the undersurface (right side surface in FIG. 2) thereof comes close to the undersurface (left side surface in FIG. 2) of the rear lid 16 with them being opposed to each other as shown in FIG. 2, and the front lid 15 is held slightly upright with the guide projection sections 15*a* thereof being positioned in the rear end portions of the guide sections 19. In addition, the rear lid 16 is held upright by its rear end portion being further rotated around the rotary fulcrum sections 18 in the clockwise direction.

Here, the guide projection sections 15*a* of the front lid 15 are supported by the rear end portions of the guide sections 19, whereby the front lid 15 is held slightly upright above the rear end portion of the keyboard section 7, as shown in FIG. 2. As a result , the folded keyboard lid 14 is held upright above the rear end portion of the keyboard section 7 with the undersurface (right side surface in FIG. 2) of the front lid 15 and the undersurface (left side surface in FIG. 2) of the rear lid 16 being positioned opposed to and close to each other, whereby the keyboard section 7 is exposed. Also, here, weight is added to the rear end portion of the standing front lid 15 from the front end portion of the rear lid 16 which is held upright by the rotary fulcrum sections 18, whereby the guide projection sections 15*a* stop movement in the end portions of the guide sections 19 on the side of the cover plate 12*a*.

In this state where the keyboard section 7 has been exposed, a musical performance can be performed by the plurality of keys 8 of the keyboard section 7 being depressed. Specifically, when a key 8 is depressed, the hammer member 10*a* of the action mechanism section 10 is rotated and thereby applies an action load to the key 8. In addition, at this timing, the switching circuit section 11 of the action mechanism section 10 performs a switching action and outputs an electrical signal. Then, a musical sound based on the electrical signal from the switching circuit section 11 is emitted from the loudspeaker (not shown)

As described above, the keyboard lid opening and closing apparatus 13 of this keyboard instrument includes the instrument case 1 provided with the keyboard section 7; the keyboard lid 14 which is constituted by the front lid 15 and the rear lid 16 whose lengths in the front-rear direction of the keyboard section 7 are different from each other being foldably connected to each other by the coupling member 17, and openably and closably covers the keyboard section 7; the rotary fulcrum sections 18 which support the rear end portion of the rear lid 16 such that the rear lid 16 is rotatable with respect to the instrument case 1, and by which the keyboard lid 14 is folded and the front lid 15 is held upright above the rear portion of the keyboard section 7 when the keyboard lid 14 is opened to expose the keyboard section 7; and the guide sections 19 which guide the front end portion of the front lid 15 in the front-rear direction of the keyboard section 7. As a result, the keyboard lid 14 can be stably and smoothly opened or closed.

That is, in the keyboard lid opening and closing apparatus 13 of this keyboard instrument, when the keyboard lid 14 is to be opened or closed, the rear lid 16 can be rotated around the rotary fulcrum sections 18 with its rear end portion being supported by the rotary fulcrum sections 18. As a result of this rotation of the rear lid 16, the front end portion of the front lid 15 is guided by the guide section 19, whereby the front lid 15 can be held upright. Therefore, even though the lengths of the front lid 15 and the rear lid 16 in the front-rear direction of the keyboard section 7 are different from each other, the keyboard lid 14 can be stably and smoothly opened or closed. In addition, the keyboard lid 14 is not required to be housed in the instrument case 1, and therefore the instrument case 1 can be made compact.

For example, when opening the keyboard lid 14 so as to expose the keyboard section 7, the instrument player holds the lower front end of the front lid 15, and pushes the front lid 15 in the posterior direction of the keyboard section 7 while being pushed upward. As a result, the guide projection sections 15*a* of front lid 15 start moving toward an area posterior to the keyboard section 7 along the guide sections 19, and the rear end portion of the rear lid 16 start rotating around the rotary fulcrum sections 18 in the clockwise direction. Consequently, the front lid 15 and the rear lid 16 are rotated centering on the coupling member 17, whereby the keyboard lid 14 can be unfailingly and favorably folded.

As a result, the guide projection sections 15*a* of the front lid 15 are positioned in the rear end portions of the guide sections 19 so as to be supported therein, and the rear end portion of the rear lid 16 is held upright by the rotary fulcrum sections 18. Consequently, the guide projection sections 15*a* of the front lid 15 are supported in the rear end portions of the guide sections 19 with the front lid 15 and the rear lid 16 being positioned close to and opposed to each other, whereby the front lid 15 can be held substantially upright above the rear portion of the keyboard section 7.

As a result of this structure, the keyboard lid 14 can be folded and held upright stably above the rear end portion of the keyboard section 7, and the keyboard section 7 can be favorably exposed from the front side of the instrument case 1, so that the instrument player can perform a musical performance by depressing the plurality of keys 8 of the keyboard section 7 in this state. In addition, the keyboard section 7 is not required to be housed in the instrument case 1, and therefore the instrument case 1 can be made compact.

Also, when the instrument player is performing a musical performance by depressing the plurality of keys 8 of the keyboard section 7, the front lid 15 is being held substantially upright above the rear portion of the keyboard section 7. As a result of this structure, the guide projection sections 15*a* of the front lid 15 can be hidden by the front lid 15, and the coupling member 17 can be hidden so as not to be seen from the outside, which are favorable in appearance and design. In addition, the instrument player's hands and fingers are reflected on the standing front lid 15, whereby a touch of class is added.

Also, in this structure, the length of the front lid 15 in the front and rear direction is formed longer than that of the rear lid 16. As a result, when the front lid 15 is held substantially upright above the rear portion of the keyboard section 7, the rear lid 16 and the rotary fulcrum sections 18 are unfailingly and favorably hidden by the front lid 15, which is also favorable in appearance and design.

Moreover, the rotary fulcrum sections 18 are provided at positions where they are located higher than the front end portion of the front lid 15 and do not come in contact with the guide projection sections 15*a* when the keyboard lid 14 is folded and the keyboard section 7 is exposed. Accordingly, when the front lid 15 is held substantially upright above the rear portion of the keyboard section 7, the front end portion of the front lid 15 is positioned below the rotary fulcrum sections 18, whereby the rotary fulcrum sections 18 are hidden by the front lid 15, and the front lid 15 is supported in a state of being hanged by the rear lid 16 which is being supported by the rotary fulcrum sections 18. As a result of this structure, the front lid 15 can be stably and favorably held upright.

Note that, although the shaft sections 18*a* and the guide sections 19 in this embodiment are provided in the keyboard lid supporting sections 5*c* embedded in the pair of side plates 5, they may be provided in the side plates 15 directly.

(Second Embodiment)

Next, a second embodiment in which the present invention has been applied in a keyboard instrument is described with reference to FIG. 3 to FIG. 5. Note that sections identical to those of the first embodiment shown in FIG. 1 and FIG. 2 are provided with the same reference numerals.

Figure 4:
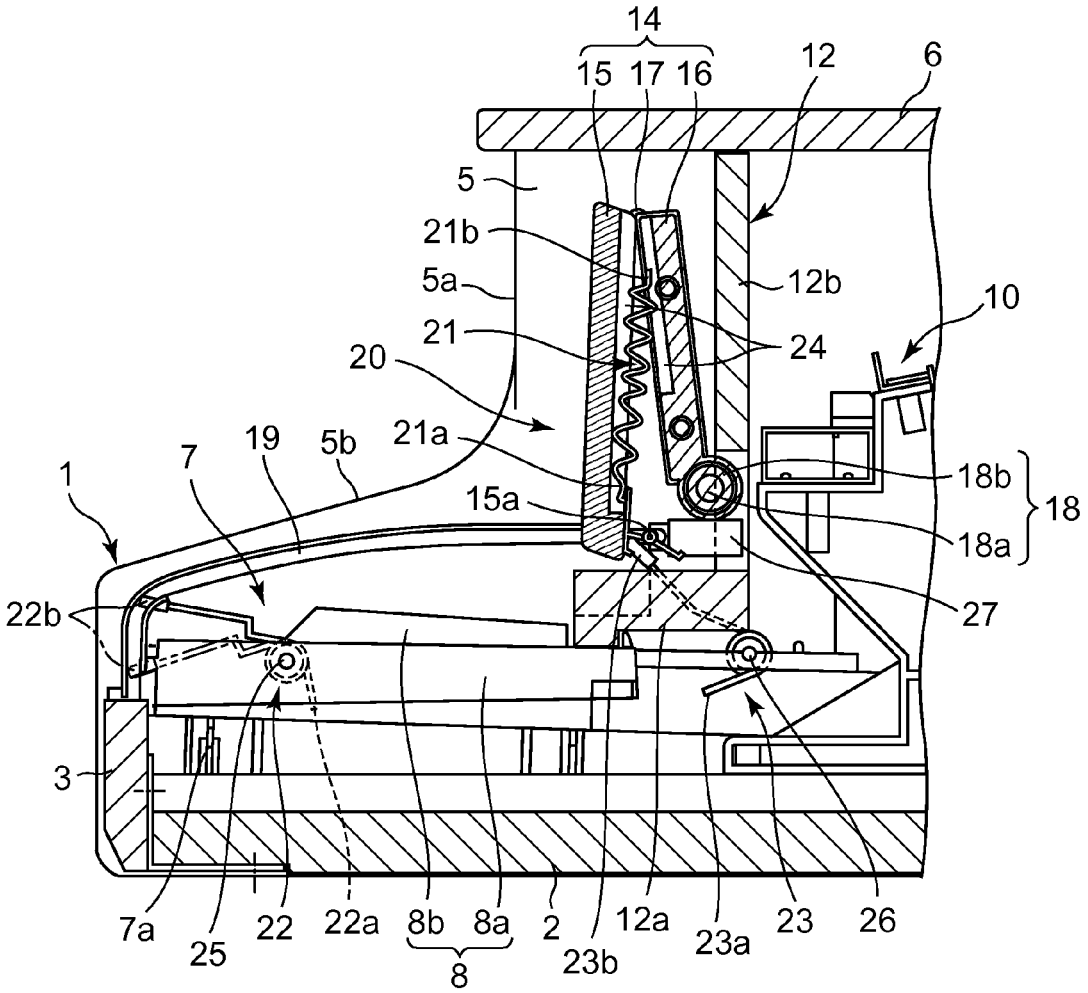
FIG. 4 is a sectional view of the main section of the keyboard instrument shown in FIG. 3, in which the keyboard lid has been mountain-folded to expose the keyboard section.

As shown in FIG. 3 and FIG. 4, the structure of a keyboard lid opening and closing apparatus 20 in this keyboard instrument is substantially the same as that of the first embodiment except that a spring member 21 is included that forces the front lid 15 and the rear lid 16 in their folding directions, and a pair of first braking sections 22 and a pair of second braking sections 23 that brake the movement of the front end portion of the front lid 15.

The spring member 21 is a helical extension spring whose one end portion 21*a* is attached to the undersurface of the front portion of the front lid 15 and the other end portion 21*b* is attached to the undersurface of the front portion of the rear lid 16, as shown in FIG. 3 and FIG. 4. That is, the spring member 21 forces the front lid 15 and the rear lid 16 in their folding directions by pulling them toward each other. In this embodiment, spring housing grooves 24 for housing the spring member 21 are provided in the undersurface (right side surface in FIG. 4) of the front lid 15 and the undersurface (left side surface in FIG. 4) of the rear lid 16.

As a result of this structure, when the keyboard lid 14 is to be opened to expose the keyboard section 7, the keyboard lid 14 is lightly mountain-folded by the spring force of the spring member 21, as shown in FIG. 3 and FIG. 4. Also, when the folded and standing keyboard lid 14 is to be unfolded to be closed, the front lid 15 is prevented by the spring force of the spring member 21 from being rapidly closed.

Also, each first braking section 22 is a torsion coil spring structured such that its coil portion is attached to a supporting projection section 25 provided on an inner surface portion of each side plate 5 of the instrument case 1 on the side of the front portion of the keyboard section 7; its one end portion 22*a* is attached to the inner surface of the corresponding side plate 5; and the other end portion 22*b* is positioned in the upper side of the front end portion of the corresponding guide section 19 in the movement path of the corresponding guide projection section 15*a* of the front lid 15, and resiliently displaced between the upper side and the lower side of the front end portion of this guide section 19, as shown in FIG. 3 and FIG. 4.

As a result, the first braking section 22 is structured such that, if the guide projection section 15*a* provided on the front end portion of the front lid 15 comes in resilient contact with the other end portion 22*b* of the first braking section 22 when the keyboard lid 14 is closed to cover the keyboard section 7, the other end portion 22*b* is resiliently displaced from the upper side of the front end portion of the guide section 19 to the lower side in the movement path of the guide projection section 15*a* of the front lid 15, and thereby brakes the closing movement of the front lid 15 so that the front lid 15 is closed slowly, as shown in FIG. 3.

Also, the first braking section 22 is structured such that, when the keyboard lid 14 is to be opened by the front lid 15 being pushed upward and moved toward an area posterior to the keyboard section 7, the front lid 15 starts moving by weak force because the guide projection section 15*a* of the front lid 15 is being pushed upward by the other end portion 22*b* of the first braking section 22 resiliently, as shown in FIG. 3.

Figure 5:
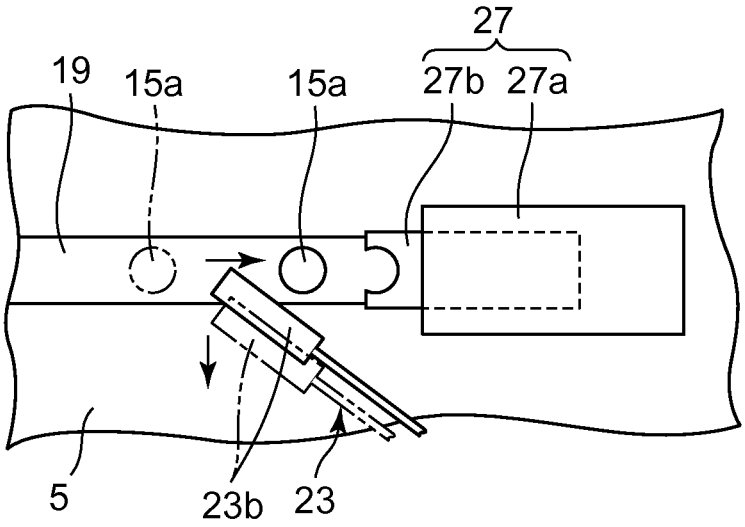
FIG. 5 is an enlarged view of the main section of the keyboard instrument shown in FIG. 4, in which a second braking section and a lock section are shown.

On the other hand, each second braking section 23 is a torsion coil spring structured such that its coil portion is attached to a supporting projection section 26 provided on an inner surface portion of each side plate 5 of the instrument case 1 on the side of the rear portion of the keyboard section 7; its one end portion 23*a* is attached to the inner surface of the corresponding side plate 5; and the other end portion 23*b* resiliently and retractably protrudes into the movement path of the corresponding guide projection section 15*a* of the front lid 15 in the rear end portion of the corresponding guide section 19, as shown in FIG. 4 and FIG. 5.

In this embodiment, the other end portion 23*b* of the second braking section 23 resiliently and retractably protrudes into the movement path of the guide projection section 15*a* of the front lid 15 in the rear end portion of the guide section 19 in a state of being oriented obliquely upward toward the front side (left side in FIG. 5) of the guide section 19, as shown FIG. 4 and FIG. 5.

As a result, the second braking section 23 is structured such that, if the guide projection section 15*a* of the front lid 15 comes in resilient contact with the other end portion 23*b* of the second braking section 23 when the keyboard lid 14 is opened to expose the keyboard section 7, the other end portion 23*b* is resiliently displaced toward a direction which is pushed out of the movement path of the guide projection section 15*a* of the front lid 15 in the rear end portion of the guide section 19, and thereby brakes the opening movement of the front lid 15 so as to rapidly decelerate the movement of the front lid 15.

In this embodiment, the second braking section 23 is structured such that the other end portion 23*b* is resiliently displaced toward the direction which is pushed out of the movement path of the guide projection section 15*a* of the front lid 15 by the guide projection section 15*a* moved from the front side (left side in FIG. 5) of the guide section 19 to the rear side (right side in FIG. 5), and a click feeling is provided to the guide projection section 15*a* by the guide projection section 15*a* surmounting the other end portion 23*b*, as shown in FIG. 4 and FIG. 5.

That is, this second braking section 23 rapidly decelerates the movement of the front lid 15 when the guide projection section 15*a* of the front lid 15 is moved from the front side of the guide section 19 to the rear side and comes in contact with the tip of the other end portion 23*b* of the second braking section 23, and rapidly accelerates the movement of the front lid 15 when the guide projection section 15*a* of the front lid 15 surmounts the other end portion 23*b* of the second braking section 23 by resiliently displacing it, so that a click feeling is provided to the guide projection section 15*a*, as shown in FIG. 4 and FIG. 5.

Also, the second braking section 23 is structured such that, when the guide projection section 15*a* of the front lid 15 surmounts the other end portion 23*b*, the other end portion 23*b* protrudes into the movement path of the guide projection section 15*a* by resilient restoration so that the guide projection section 15*a* of the front lid 15 is not undesirably moved toward the front side (left side in FIG. 5) of the guide section 19, as shown in FIG. 4 and FIG. 5.

Moreover, the second braking section 23 is structured such that, when the front lid 15 above the rear portion of the keyboard section 7 is moved frontward to close the keyboard lid 14, the guide projection section 15*a* of the front lid 15 is moved along the tilt of the other end portion 23*b* of the second braking section 23, surmounts the other end portion 23*b* by resiliently displacing it by weak force, and thereby passes through the other end portion 23*b*, as shown in FIG. 4 and FIG. 5.

Also, this keyboard lid opening and closing apparatus 20 includes a lock section 27 which engageably or disengageably locks one of the guide projection sections 15*a* of the front lid 15 when the keyboard lid 14 is opened and the keyboard section 7 is exposed, as shown in FIG. 4 and FIG. 5. This lock section 27 includes a main body section 27*a* which is attached to the inner surface of the corresponding sideplate 5 of the instrument case 1 and positioned behind the rear end portion of the corresponding guide section 19, and a catch section 27*b* which is retractably provided in the main body section 27*a* and disengageably locks the corresponding guide projection section 15*a* of the front lid 15.

That is, the lock section 27 is structured such that, when the guide projection section 15*a* of the front lid 15 surmounts the other end portion 23*b* of the second braking section 23 and the keyboard lid 14 is opened to expose keyboard section 7, the catch section 27*b* catches and locks the guide projection section 15*a* of the front lid 15, whereby the front lid 15 is locked in a state of being held upright above the rear portion of the keyboard section 7, as shown in FIG. 3 and FIG. 4.

Also, this lock section 27 is structured such that, when the front lid 15 is to be moved frontward to close the keyboard lid 14 with the guide projection section 15*a* of the front lid 15 being caught and locked by the catch section 27*b*, the lock of the guide projection section 15*a* of the front lid 15 by the catch section 27*b* is released by the front lid 15 being pushed once toward an area posterior to the keyboard section 7, whereby the guide projection section 15*a* of the front lid 15 is released from the catch section 27*b*, as shown in FIG. 4.

By the keyboard lid opening and closing apparatus 20 of this keyboard instrument as well, operations and effects similar to those of the first embodiment can be provided. In addition, since the spring member 21 is included which forces the front lid 15 and the rear lid 16 in the direction in which they come close to each other by being tilted, the keyboard lid 14 can be folded with little strength by the spring force of the spring member 21 when the keyboard lid 14 is opened to expose the keyboard section 7.

Also, with this keyboard lid opening and closing apparatus 20, the front lid 15 can be prevented by the spring force of the spring member 21 from being undesirably closed when the keyboard section 7 is being exposed by the keyboard lid 14 being folded. In addition, when the keyboard lid 14 folded and held upright is to be unfolded and closed, the front lid 15 can be prevented by the spring force of the spring member 21 from being rapidly closed, and whereby the keyboard lid 14 can be safely closed, which improves operability related to the opening and closing of the keyboard lid 14.

Moreover, this keyboard lid opening and closing apparatus 20 includes the first braking sections 22 which resiliently brake the movement of the front end portion of the front lid 15 when the keyboard lid 14 is closed and the keyboard section 7 is exposed. Therefore, when the keyboard lid 14 is to be closed to cover the keyboard section 7, the closing movement of the front lid 15 can be braked by the first braking sections 22 so that the front lid 15 can be closed slowly.

Accordingly, with this keyboard lid opening and closing apparatus 20, the instrument player does not get his or her hand or finger caught in the keyboard lid 14 when closing the keyboard lid 14 to cover the keyboard section 7. As a result , the keyboard lid 14 is closed safely and abnormal noise or the like is not made. Also, when opening the keyboard lid 14 to expose the keyboard section 7, the instrument player can move the front lid 15 with little strength by the action of the first braking sections 22.

In this embodiment, each first braking section 22 is structured such that the coil portion of the torsion coil spring is attached to the supporting projection section 25 provided in each side plate 5 of the instrument case 1; the one end portion 22*a* is attached and fixed to the corresponding side plate 5; and the other end portion 22*b* is positioned above the front end portion of the corresponding guide section 19 in the movement path of the corresponding guide projection section 15*a* of the front lid 15, and resiliently displaced between the upper side and the lower side of the front end portion of this guide section 19. Accordingly, the front lid 15 can be braked reliably.

That is, the first braking section 22 is structured such that, if the guide projection section 15*a* of the front lid 15 comes in resilient contact with the other end portion 22*b* of the first braking section 22 when the keyboard lid 14 is closed to cover the keyboard section 7, the other end portion 22*b* is resiliently displaced from the upper side of the front end portion of the guide section 19 to the lower side in the movement path of the guide projection section 15*a*, and thereby brakes the closing movement of the front lid 15 so that the front lid 15 is closed slowly.

Also, the first braking section 22 pushes the guide projection section 15*a* of the front lid 15 upward by the resilient return force of the other end portion 22*b* of the first braking section 22 when the keyboard lid 14 is opened by the front lid 15 being pushed upward and moved toward an area posterior to the keyboard section 7. As a result of this structure, the front lid 15 can be pushed upward and moved with little strength, which improves operability related to the opening and closing of the keyboard lid 14.

Also, this keyboard lid opening and closing apparatus 20 includes the second braking sections 23 which resiliently brake the movement of the front end portion of the front lid 15 when the keyboard lid 14 is opened to expose the keyboard section 7. Accordingly, when the keyboard lid 14 is to be opened to expose the keyboard, the opening movement of the front lid 15 can be braked by the second braking sections 23 so that the movement of the front lid 15 is decelerated. In addition, when the keyboard lid 14 is to be closed to cover the keyboard section 7, the closing movement of the front lid 15 can be braked by the second braking sections 23 so that the front lid 15 is prevented from being undesirably closed.

In this embodiment, each second braking section 23 is structured such that the coil portion of the torsion coil spring is attached to the supporting projection section 26 provided on each side plate 5 of the instrument case 1; the one end portion 23*a* is attached and fixed to the corresponding side plate 5; and the other end portion 23*b* resiliently and retractably protrudes into the movement path of the corresponding guide projection section 15*a* of the front lid 15 in the rear end portion of the corresponding guide section 19 in a state of being oriented obliquely upward toward the front side of the corresponding guide section 19.

That is, the second braking section 23 is structured such that, if the guide projection section 15*a* of the front lid 15 comes in resilient contact with the other end portion 23*b* of the second braking section 23 when the keyboard lid 14 is opened to expose the keyboard section 7, the other end portion 23*b* is resiliently displaced toward the direction which is pushed out of the movement path of the guide projection section 15*a*, and thereby brakes the opening movement of the front lid 15 so as to decelerate the movement of the front lid 15.

In this embodiment, since the other end portion 23*b* is oriented obliquely upward toward the front side of the guide section 19, the second braking section 23 can provide a click feeling to the guide projection section 15*a* by the guide projection section 15*a* of front lid 15 resiliently displacing the other end portion 23*b* in the direction in which the other end portion 23*b* is pushed out of the movement path of the guide projection section 15*a* and surmounts the other end portion 23*b*.

That is, the second braking section 23 rapidly decelerates the movement of the front lid 15 by the guide projection section 15*a* coming in contact with the other end portion 23*b* for resiliently displacing and surmounting the other end portion 23*b*, and rapidly accelerates the movement of the front lid 15 by the guide projection section 15*a* surmounting the other end portion 23*b*, whereby a click feeling is provided to the guide projection section 15*a*. As a result of this structure, the instrument player can confirm that the guide projection section 15*a* of the front lid 15 has overshot the other end portion 23*b* of the second braking section 23.

Also, the second braking section 23 is structured such that, when the guide projection section 15*a* of the front lid 15 surmounts the other end portion 23*b*, the other end portion 23*b* protrudes into the movement path of the guide projection section 15*a* by resilient restoration. As a result, by the other end portion 23*b* resiliently returned and protruding thereinto, the guide projection section 15*a* of the front lid 15 can be prevented from being undesirably moved toward the front side of the guide section 19, whereby the front lid 15 can be held upright securely.

Moreover, when the front lid 15 above the rear portion of the keyboard section 7 is moved frontward to close the keyboard lid 14, since the other end portion 23*b* of the second braking section 23 is resiliently protruding into the movement path of the guide projection section 15*a* in the rear end portion of the guide section 19 in a state of being oriented obliquely upward toward the front side of the guide section 19, the guide projection section 15*a* is moved along the tilt of the other end portion 23*b*. As a result of this structure, the other end portion 23*b* can be easily displaced resiliently, whereby the guide projection section 15*a* favorably surmounts the other end portion 23*b*.

Also, this keyboard lid opening and closing apparatus 20 includes the lock section 27 which engageably or disengageably locks the front end portion of the front lid 15 when the keyboard lid 14 is opened and the keyboard section 7 is exposed. As a result, when the keyboard lid 14 is opened to expose the keyboard section 7, the front end portion of the front lid 15 is locked with the front lid 15 being held upright above the rear portion of the keyboard section 7. As a result of this structure, the front lid 15 can be securely held upright above the rear portion of the keyboard section 7.

In this embodiment, the lock section 27 includes the main body section 27*a* which is attached to the inner surface of the corresponding side plate 5 of the instrument case 1 and positioned behind the rear end portion of the corresponding guide section 19, and the catch section 27*b* which is retractably provided in the main body section 27*a* and disengageably locks the corresponding guide projection section 15*a* of the front lid 15. As a result of this structure, the guide projection section 15*a* of the front lid 15 can be locked by the catch section 27*b*, whereby the front lid 15 can be securely held upright above the rear portion of the keyboard section 7.

That is, this lock section 27 is structured such that, when the guide projection section 15*a* of the front lid 15 surmounts the other end portion 23*b* of the second braking section 23 and the keyboard lid 14 is opened to expose keyboard section 7, the catch section 27*b* catches and locks the guide projection section 15*a* of the front lid 15. As a result of this structure, the front lid 15 can be securely locked in a state of being held upright above the rear portion of the keyboard section 7.

Also, this lock section 27 is structured such that, when the front lid 15 is to be moved frontward to close the keyboard lid 14 with the guide projection section 15*a* of the front lid 15 being caught and locked by the catch section 27*b*, the lock of the guide projection section 15*a* of the front lid 15 by the catch section 27*b* is released by the front lid 15 being pushed once toward an area posterior to the keyboard section 7. As a result of this structure, the guide projection section 15*a* of the front lid 15 can be easily released from the catch section 27*b* by a simple operation.

In the above-described second embodiment, as the energizing member which forces the front lid 15 and the rear lid 16 in the direction in which they come close to each other so that the keyboard lid 14 is mountain-folded, the spring member 21 constituted by a helical extension spring is used. However, the present invention is not limited thereto, and a torsion coil spring or an elastic wire rod such as an elastic cord may be used.

Also, in the above-described second embodiment, as the first and second braking sections 22 and 23 which brake the movement of the front end portion of the front lid 15, the torsion coil springs are used. However, the present invention is not limited thereto, and elastic members, such as rubber or cushioning materials, may be used.

Moreover, in the above-described second embodiment, the lock section 27 includes the main body section 24*a* and the catch section 24*b*, and the catch section 24*b* catches and locks the corresponding guide projection section 15*a* of the front lid 15. However, the present invention is not limited thereto, and a structure may be adopted in which a magnet is used as the lock section 27, and the guide projection section 15*a* of the front lid 15 is magnetically attached by this magnet. In this structure, the guide projection section 15*a* of the front lid 15 is formed of metal containing a magnetic material.

(Third Embodiment)

Next, a third embodiment in which the present invention has been applied in a keyboard instrument is described with reference to FIG. 6. Note that, in this case as well, sections identical to those of the first embodiment shown in FIG. 1 and FIG. 2 are provided with the same reference numerals.

Figure 6:
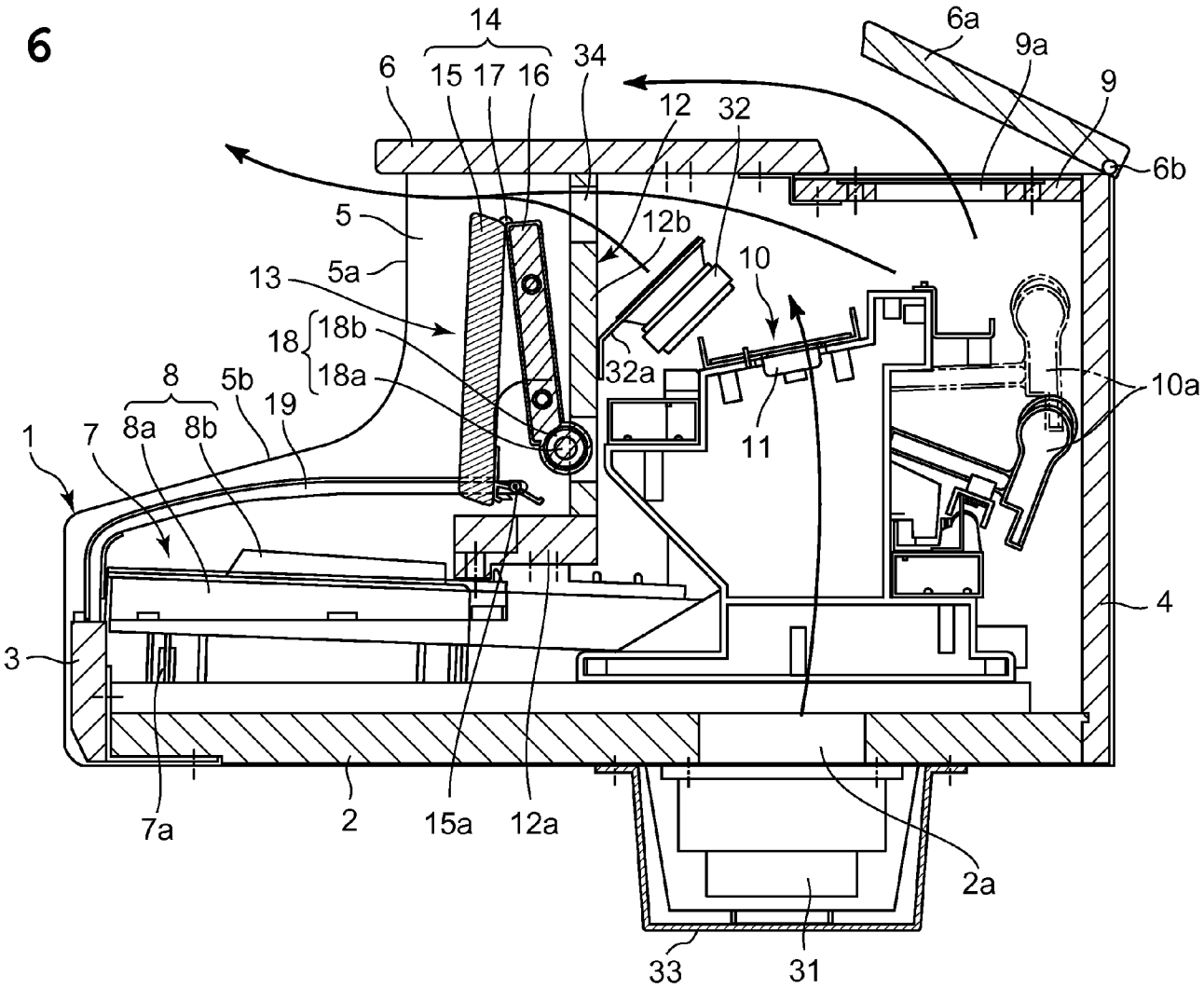
FIG. 6 is a sectional view of a third embodiment where the present invention has been applied in a keyboard instrument, in which a state is shown where a musical sound has been emitted with a keyboard lid being mountain-folded to expose a keyboard section.

The structure of this keyboard instrument is substantially the same as that of the first embodiment except that a first loudspeaker 31 and a second loudspeaker 32 are attached, as shown in FIG. 6.

The first loudspeaker 31 is a full-range speaker, and attached to the base plate 2 of the instrument case 1, as shown in FIG. 6. That is, this first loudspeaker 31 is attached to a portion posterior to the keyboard section 7, or more specifically, a portion of the undersurface of the base plate 2 below the action mechanism section 10, in a state of being oriented upward. In this embodiment, a through hole 2*a* for sound emission is provided in the base plate 2, corresponding to this first loudspeaker 31.

In addition, a loudspeaker box 33 for housing the first loudspeaker 31 is attached to the undersurface of this base plate 2, as shown in FIG. 6. As a result, the first loudspeaker 31 is structured such that high-pitched sounds are emitted toward the inside of the instrument case 1 through the through hole 2*a* of the base plate 2, and low-pitched sounds are emitted toward the lower side of the instrument case 1 from the loudspeaker box 33.

The second loudspeaker 32 is a tweeter or a woofer, and attached to the inner surface of the upper front plate 12*b* of the partition member 12 that is a partition between the keyboard section 7 and the action mechanism section 10, as shown in FIG. 6. Specifically, the second loudspeaker 32 is attached in a state of being oriented obliquely upward toward the front side by an attachment plate 32*a*, and positioned above the front portion of the action mechanism section 10 inside the instrument case 1.

In this embodiment, a first sound hole 34 is provided in a portion of the upper front plate 12*b* of the partition member 12 in an area anterior and superior to the second loudspeaker 32, as shown in FIG. 6. This first sound hole 34 is structured such that its upper portion is positioned above the upper portion of the standing keyboard lid 14 when the keyboard lid 14 is mountain-folded and held upright above the rear portion of the keyboard section 7.

As a result, the first sound hole 34 is structured such that high-pitched sounds emitted toward the inside of the instrument case 1 from the first loudspeaker 31 and passed by the action mechanism section 10 are emitted to the outside of the front side of the instrument case 1, and sounds emitted from the second loudspeaker 32 are directly emitted to the outside of the front side of the instrument case 1, as shown in FIG. 6.

Also, in the area of the rear portion of the top plate 6, the sound emission lid 6*a* is openably and closably provided as in the case of the first embodiment , and the auxiliary top plate 9 is provided below this sound emission lid 6*a*. In this auxiliary top plate 9, the sound hole 9*a* (referred to as the second sound hole 9*a* in this third embodiment) is provided penetrating through the auxiliary top plate 9 in the vertical direction. In this embodiment, the second sound emission lid 6*a* is structured such that its rear end portion is rotatably attached to the upper end portion of the rear plate 4 by the hinge 6*b*, and vertically rotated around the hinge 6*b* so that the second sound hole 9*a* of the auxiliary top plate 9 is exposed or covered.

As a result, the second sound hole 9*a* is structured such that it is exposed when the sound emission lid 6*a* is vertically rotated and tilted obliquely upward, and high-pitched sounds emitted toward the inside of the instrument case 1 from the first loudspeaker 31 and passed by the action mechanism section 10 are emitted above the instrument case 1 and reflected by the sound emission lid 6*a* toward an area anterior to the instrument case 1, as shown in FIG. 6.

By this keyboard instrument as well, operations and effects similar to those of the first embodiment can be provided. In addition, when a musical performance is performed by the plurality of keys 8 of the keyboard section 7 being depressed with the keyboard lid 14 being folded and held upright above the rear portion of keyboard section 7, musical sounds in accordance with the musical performance are favorably generated by the first loudspeaker 31 and the second loudspeaker 32.

With this keyboard instrument, low-pitched sounds among musical sounds generated in the first loudspeaker 31 can be favorably emitted toward an area inferior to the instrument case 1 from the loudspeaker box 33. Also, with this keyboard instrument, high-pitched sounds among musical sounds generated in the first loudspeaker 31 can be unfailingly emitted toward the inside of the instrument case 1 from the through hole 2*a* of the base plate 2, and the high-pitched sound emitted toward the inside of the instrument case 1 can be favorably emitted toward an area anterior to the instrument case 1 from the first sound hole 34 provided in the upper front plate 12*b* of the partition member 12.

That is, with this keyboard instrument, high-pitched sounds emitted toward the inside of the instrument case 1 from the first loudspeaker 31 pass by the action mechanism section 10. Then, these high-pitched sounds are emitted toward the front side of the instrument case 1 from the first sound hole 34 provided in the upper front plate 12*b* of the partition member 12, and then favorably emitted toward an area anterior to the instrument case 1 through an area between the standing keyboard lid 14 and the top plates 6.

In this embodiment, when the sound emission lid 6*a* of the top plate 6 is opened and the second sound hole 9*a* is exposed, high-pitched sounds generated in the first loudspeaker 31 and emitted toward the inside of the instrument case 1 pass by the action mechanism section 10 and are emitted toward an area anterior to the instrument case 1 from the first sound hole 34, while at the same time portions of the high-pitched sounds are emitted above the instrument case 1 from the second sound hole 9*a*, and favorably reflected by the sound emission lid 6*a* toward an area anterior to the instrument case 1.

Also, with this keyboard instrument, musical sounds generated in the second loudspeaker 32 are emitted toward the front side of the instrument case 1 from the first sound hole 34 of the upper front plate 12*b* of the partition member 12, and then favorably emitted toward an area anterior to the instrument case 1 through an area between the standing keyboard lid 14 and the top plates 6. As a result of this structure, with this keyboard instrument, musical sounds generated in the first loudspeaker 31 and the second loudspeaker 32 can be favorably emitted toward an area anterior to the instrument case 1.

Note that the above-described third embodiment may be structured to include the spring member 21 which forces the front lid 15 and the rear lid 16 in their folding directions, the first and second braking sections 22 and 23 which brake the movement of the front end portion of the front lid 15, and the lock section 27 which locks the corresponding guide projection section 15*a* of the front lid 15, as in the case of the second embodiment.

Also, in the third embodiment, the first loudspeaker 31 is upwardly provided on the undersurface of the base plate 2 of the instrument case 1. However, the present invention is not limited thereto, and the first loudspeaker 31 may be downwardly provided on the undersurface of the base plate 2. Also, the first loudspeaker 31 may be provided inside the instrument case 1. In this case, the first loudspeaker 31 may be upwardly or downwardly provided on the upper surface of the base plate 2 inside the instrument case 1, or may be upwardly or downwardly provided on the undersurface of the top plate 6 inside the instrument case 1.

Moreover, in each of the first to third embodiments, the action mechanism section 10 is provided inside the instrument case 1 and positioned behind the keyboard section 7. However, the present invention is not limited thereto, and a structure may be adopted in which a hammer member that applies an action load is provided for each of the plurality of keys 8 of the keyboard section 7. Also, the action mechanism section 10 and the hammer members are not necessarily required to be provided.

In the above-described first to third embodiments, the keyboard lid 14 covers the keyboard section 7 with the front lid 15 and the rear lid 16 being slightly tilted by the coupling member 17 by mountain folding. This is because, in this way, the keyboard lid 14 can be easily folded only by being pushed upward, which improves operability related to the opening of the keyboard lid 14. However, a structure may be adopted in which the keyboard lid 14 covers the keyboard section 7 with the front lid 15 and the rear lid 16 being flush with each other.

However, in this structure where the front lid 15 and the rear lid 16 are flush with each other, there is a possibility that the keyboard lid 14 is not easily opened as compared to the structure where the front lid 15 and the rear lid 16 are tilted. Therefore, a spring or the like may be provided between the rear end portion of the front lid 15 and the front end portion of the rear lid 16 so as to assist the instrument player in pushing the keyboard lid 14 upward.

Figure 7:
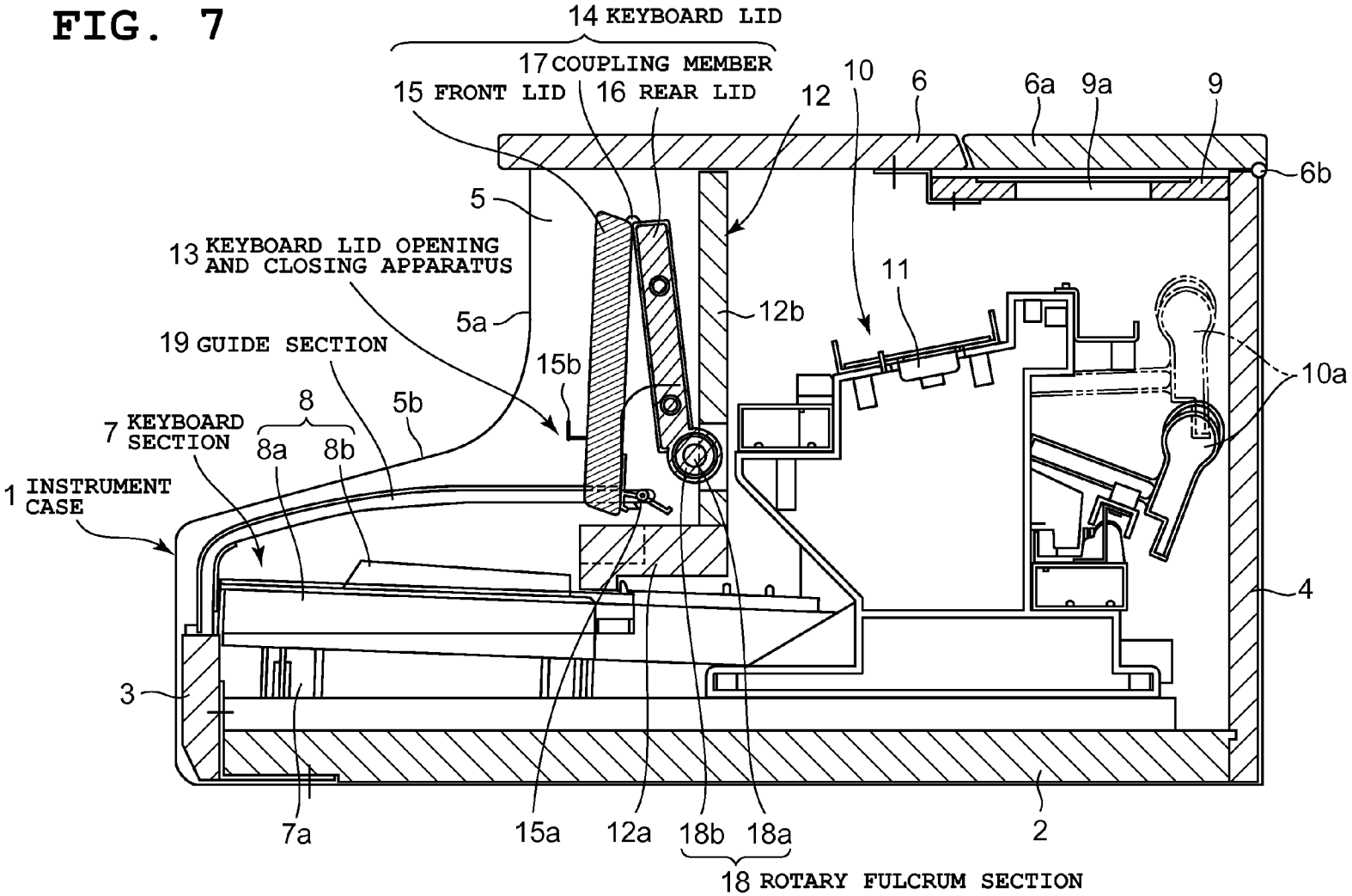
FIG. 7 is a sectional view of the keyboard instrument shown in FIG. 2, in which a music stand section has been provided on the surface of the front lid of the keyboard lid.

Also, a structure where a music stand 15*b* is provided on the surface of the front plate 15 may be adopted, as shown in FIG. 7. By placing a musical score on the music stand 15*b* with the keyboard section 7 being exposed and the front lid 15 being held substantially upright above the rear end portion of the keyboard section 7, the instrument player can put the musical score at the center of his or her sight.

Moreover, although each rotary fulcrum section 18 is constituted by the shaft section 18*a* and the bearing section 18*b* in the above-described first to third embodiments, the present invention is not limited thereto, and a structure may be adopted in which the rotary fulcrum section 18 is provided with a damper mechanism that applies a load to the closing movement of the keyboard lid 14 when it is closed to cover the keyboard section 7.

While the present invention has been described with reference to the preferred embodiments, it is intended that the invention be not limited by any of the details of the description therein but includes all the embodiments which fall within the scope of the appended claims.

What is claimed is:

1. A keyboard instrument comprising:

a keyboard section;

an instrument case in which the keyboard section is provided;

a keyboard lid which has a front lid and a rear lid connected by a coupling member such that the keyboard lid is foldable, and exposes the keyboard section in a folded state;

a rotary fulcrum section which is provided above the keyboard section, and rotates a rear end portion of the rear lid so that the rear lid is held above the keyboard section with a front end portion of the rear lid being positioned higher than the rear end portion of the rear lid, when the keyboard lid exposes the keyboard section;

a groove section which is provided in an inner surface of the instrument case, and includes a groove extending along an upper side of the keyboard section from a front end portion of the keyboard section to the rotary fulcrum section; and a guide projection section which is inserted into the groove;

wherein the guide projection section is positioned at a front end portion of the groove, when the keyboard lid closes the keyboard section, and is moved toward the rotary fulcrum section along the groove, when the keyboard lid exposes the keyboard section; and wherein a front end portion of the front lid is guided toward an area below the rotary fulcrum section so that the front lid is held above keyboard section with a rear end portion of the front lid being positioned higher than the front end portion of the front lid, when the keyboard lid exposes the keyboard section.

2. The keyboard instrument according to claim 1, wherein the instrument case further includes a base plate and a cover plate which covers a rear end portion of the keyboard section.

3. The keyboard instrument according to claim 2, wherein the rotary fulcrum section comprises a shaft section positioned above the cover plate, and a bearing section which has a cylindrical shape and is provided on an upper side of the rear end portion of the rear lid, the rotary fulcrum section being structured such that the rear lid is vertically rotatable around the shaft section with the shaft section being inserted in the bearing section.

4. The keyboard instrument according to claim 3, wherein a length of the front lid in a front-rear direction is longer than a length of the rear lid in the front-rear direction.

5. The keyboard instrument according to claim 4, wherein the shaft section of the rotary fulcrum section is provided at a position higher than a position of the groove section provided above the cover plate.

6. The keyboard instrument according to claim 5, wherein the shaft section of the rotary fulcrum section is provided at a position which is higher than the position of the groove section and at which the shaft section does not come in contact with the guide projection section inserted in the groove section when the keyboard lid exposes the keyboard section.

7. The keyboard instrument according to claim 1, further comprising:

an energizing member which forces surfaces of the front lid and the rear lid that oppose the keyboard section in directions where the surfaces are tilted and come close to each other.

8. The keyboard instrument according to claim 7, further comprising:

a first braking section which resiliently brakes the front end portion of the front lid when the keyboard lid is closed to cover the keyboard section; and a second braking section which resiliently brakes the front end portion of the front lid when the keyboard lid is opened to expose the keyboard section.

9. The keyboard instrument according to claim 7, further comprising:

a lock section which disengageably locks the front end portion of the front lid when the keyboard lid is opened to expose the keyboard section.

10. The keyboard instrument according to claim 1, wherein the rotary fulcrum section is provided above a rear portion of the keyboard section, and rotates a rear end portion of the rear lid so that the rear lid is held upright above the rear portion of the keyboard section with a front end portion of the rear lid being positioned higher than the rear end portion of the rear lid, when the keyboard lid exposes the keyboard section, and wherein the front end portion of the front lid is guided toward the area below the rotary fulcrum section so that the front lid is held upright above the rear portion of the keyboard section with the rear end portion of the front lid being positioned higher than the front end portion of the front lid, when the keyboard lid exposes the keyboard section.

11. The keyboard instrument according to claim 1, further comprising:

a circuit section which outputs a signal that generates a musical sound in response to a key depression operation on the keyboard section.

12. The keyboard instrument according to claim 1, further comprising:

a music stand section which is provided on a surface of a front plate.

13. A keyboard lid opening and closing apparatus comprising:

an instrument case provided with a keyboard section;

a keyboard lid which has a front lid and a rear lid connected by a coupling member such that the keyboard lid is foldable, and exposes the keyboard section in a folded state;

a rotary fulcrum section which is provided above the keyboard section, and rotates a rear end portion of the rear lid so that the rear lid is held above the keyboard section with a front end portion of the rear lid being positioned higher than the rear end portion of the rear lid, when the keyboard lid exposes the keyboard section;

a groove section which is provided in an inner surface of the instrument case, and includes a groove extending along an upper side of the keyboard section from a front end portion of the keyboard section to the rotary fulcrum section; and a guide projection section which is inserted into the groove, wherein the guide projection section is positioned at a front end portion of the groove, when the keyboard lid closes the keyboard section, and is moved toward the rotary fulcrum section along the groove, when the keyboard lid exposes the keyboard section, and wherein a front end portion of the front lid is guided toward an area below the rotary fulcrum section so that the front lid is held above keyboard section with a rear end portion of the front lid being positioned higher than the front end portion of the front lid, when the keyboard lid exposes the keyboard section.

14. An operation unit cover opening and closing apparatus comprising:

a case provided with a operation unit;

an operation unit cover which has a front cover and a rear cover connected by a coupling member such that the operation unit cover is foldable, and exposes the operation unit in a folded state;

a rotary fulcrum section which is provided above the operation unit, and rotates a rear end portion of the rear cover so that the rear cover is held above the operation unit with a front end portion of the rear cover being positioned higher than the rear end portion of the rear cover, when the operation unit exposes the operation unit;

a groove section which is provided in an inner surface of the instrument case, and includes a groove extending along an upper side of the operation unit from a front end portion of the operation unit to the rotary fulcrum section; and a guide projection section which is inserted into the groove, wherein the guide projection section is positioned at a front end portion of the groove, when the operation unit cover closes the operation unit, and is moved toward the rotary fulcrum section along the groove, when the operation unit cover exposes the operation unit, and wherein a front end portion of the front cover is guided toward an area below the rotary fulcrum section so that the front cover is held above the operation unit with a rear end portion of the front cover being positioned higher than the front end portion of the front cover, when the operation unit cover exposes the operation unit.

* * * * *